US006923679B1

(12) United States Patent
Wu

(10) Patent No.: US 6,923,679 B1
(45) Date of Patent: Aug. 2, 2005

(54) CABLE ASSEMBLY FLOATABLY MOUNTED ON A PANEL

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/773,546

(22) Filed: Feb. 6, 2004

(51) Int. Cl.[7] ..... H01R 13/73
(52) U.S. Cl. ..... 439/573
(58) Field of Search ..... 439/573, 247, 439/248, 545, 552, 378, 366, 553

(56) References Cited

U.S. PATENT DOCUMENTS

| | | | | |
|---|---|---|---|---|
| 4,647,130 | A | 3/1987 | Blair et al. | |
| 4,915,641 | A | 4/1990 | Miskin et al. | |
| 5,514,000 | A * | 5/1996 | Krause et al. | 439/248 |
| 5,547,385 | A * | 8/1996 | Spangler | 439/101 |
| 6,030,242 | A * | 2/2000 | Cunningham et al. | 439/247 |
| 6,176,738 | B1 * | 1/2001 | Consoli et al. | 439/545 |
| 6,234,817 | B1 * | 5/2001 | Hwang | 439/247 |
| 6,290,536 | B1 * | 9/2001 | Hwang et al. | 439/553 |
| 6,579,111 | B2 * | 6/2003 | Fukamachi | 439/247 |
| 6,736,659 | B1 * | 5/2004 | Wu | 439/247 |
| 6,773,286 | B1 * | 8/2004 | Wu | 439/247 |
| 6,824,419 | B1 * | 11/2004 | Wu | 439/378 |

* cited by examiner

*Primary Examiner*—Gary Paumen
*Assistant Examiner*—Phuongchi Nguyen
(74) *Attorney, Agent, or Firm*—Wei Te Chung

(57) ABSTRACT

A cable assembly (7) includes an insulative housing (1) and a number of terminals (2) received in the insulative housing. The insulative housing includes a base (10) extending along a longitudinal direction thereof, a mating portion (11) extending forwardly from a front face (101) of the base along a mating direction perpendicular to the longitudinal direction, a pair of flanges (16) located at opposite ends of the base adapted for engaging with first faces of mounting wings (82) of a panel (8), and a pair of ears (17) located at the opposite ends of the base and spaced from the flanges along the mating direction adapted for engaging with opposite second faces of the mounting wings of the panel. One of the flanges defines a through hole (160) adapted for receiving a fastening member.

3 Claims, 11 Drawing Sheets

CABLE ASSEMBLY FLOATABLY MOUNTED ON A PANEL

CROSS-REFERENCE TO RELATED APPLICATIONS

Relevant subject matter is disclosed in U.S. patent application Ser. Nos. 10/658,563 filed on Sep. 8, 2003 and entitled "ELECTRICAL CONNECTOR ASSEMBLY WITH BLIND MATE STRUCTURE", Ser. No. 10/665,843 filed on Sep. 18, 2003 and entitled "SPACE-SAVING CABLE CONNECTOR ASSEMBLY WITH BLIND MATE STRUCTURE", Ser. No. 10/671,117 filed on Sep. 24, 2003 and entitled "CABLE CONNECTOR ASSEMBLY" and Ser. No. 10/729,345 filed on Dec. 4, 2003 and entitled "FLOATABLE PANEL MOUNT CABLE ASSEMBLY", all of which are invented by the same inventor and assigned to the same assignee as this application.

BACKGROUND OF THE INVENTION

1. Field of the Invention

The present invention relates to a cable assembly, and particularly to a cable assembly adapted to be floatably mounted on a panel.

2. Description of Related Art

Cable assemblies are widely used in electronic devices for signal or power transmission. Such a cable assembly is usually needed to be float-mounted to a panel on which plural connectors are arranged side by side to form a sub module. U.S. Pat. Nos. 4,647,130 and 4,615,641 each disclose such an assembly.

The assembly disclosed in U.S. Pat. No. 4,647,130 comprises matable plug and receptacle connectors. The plug connector comprises a pair of flanges diagonally formed at opposite ends of a base thereof and a pair of guide pins disposed at opposite ends of the base and diagonally across from each other. Each flange defines a mounting hole therein and a pair of arcuate projections are located at a substantial angle from the major axis of the plug connector and are around corresponding mounting holes. A pair of elastomeric ring-like members are secured around a corresponding pair of projections. A pair of shoulder screws respectively protrude through the mounting holes and the elastomeric ring-like members to tightly engage with a panel. However, this design is complicated and increases the manufacturing cost.

U.S. Pat. No. 4,915,641 discloses a pair of matable female and male connectors each being mounted to a corresponding pair of panels, respectively. The male connector comprises a pair of flanges on opposite ends thereof and each flange defines a mounting aperture and a mounting collar therethrough to enable the float mounting of the male connector to a corresponding panel. The collar is a generally cylindrical collar having an aperture dimensioned to receive a bolt, rivet or other connecting means. However, when the female connector engages with or disengages from the male connector, the male connector is easy to rotate with respect to the panel, which results in the difficulty of ensuring a reliable electrical connection between the male connector and the female connector.

In addition, the connectors disclosed in the above-mentioned patents each are mounted on the panel in such a matter that a mating direction of the connector is perpendicular to the panel. However, in certain circumstances, the connector needs to be mounted on a panel which orientates in a direction parallel to the mating direction of the connector.

Hence, an improved floatable cable assembly is highly desired to overcome the disadvantages of the prior art.

SUMMARY OF THE INVENTION

Accordingly, an object of the present invention is to provide a floatable panel mount cable assembly which can be prevented from rotating with respect to a panel when the cable assembly engages with or disengages from a complementary connector.

Another object of the present invention is to provide a cable assembly floatably mounted to a panel which is parallel to a mating direction of the cable assembly.

In order to achieve the objects set forth, a cable assembly adapter for being mounted to mounting wings of a panel in accordance with the present invention comprises an insulative housing and a plurality of terminals received in the insulative housing. The housing includes a base along a longitudinal direction thereof, a mating portion extending forwardly from a front face of the base along a mating direction perpendicular to the longitudinal direction, a pair of flanges located at opposite ends of the base adapted for engaging with first faces of the mounting wings, and a pair of ears located at the opposite ends of the base and spaced from the flanges along the mating direction adapted for engaging with opposite second faces of the mounting wings. One of the flanges defines a through hole adapter for receiving a fastening member for mounting the cable assembly to the panel.

Other objects, advantages and novel features of the invention will become more apparent from the following detailed description when taken in conjunction with the accompanying drawings.

DETAILED DESCRIPTION OF THE PREFERRED EMBODIMENT

Figure 1:
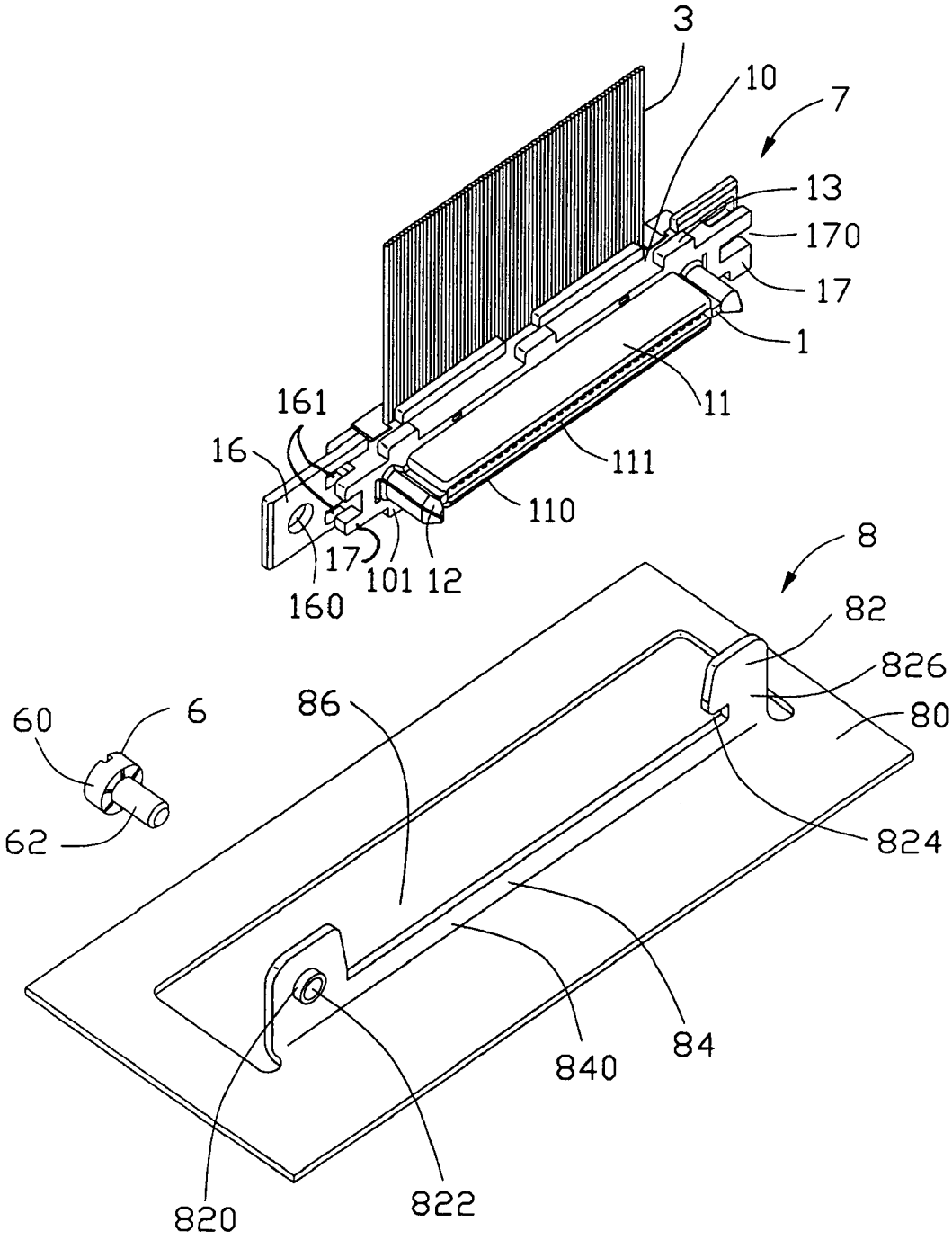
FIG. 1 is a perspective view of a cable assembly in accordance with the present invention and a panel to which the cable assembly is mounted.
Figure 2:
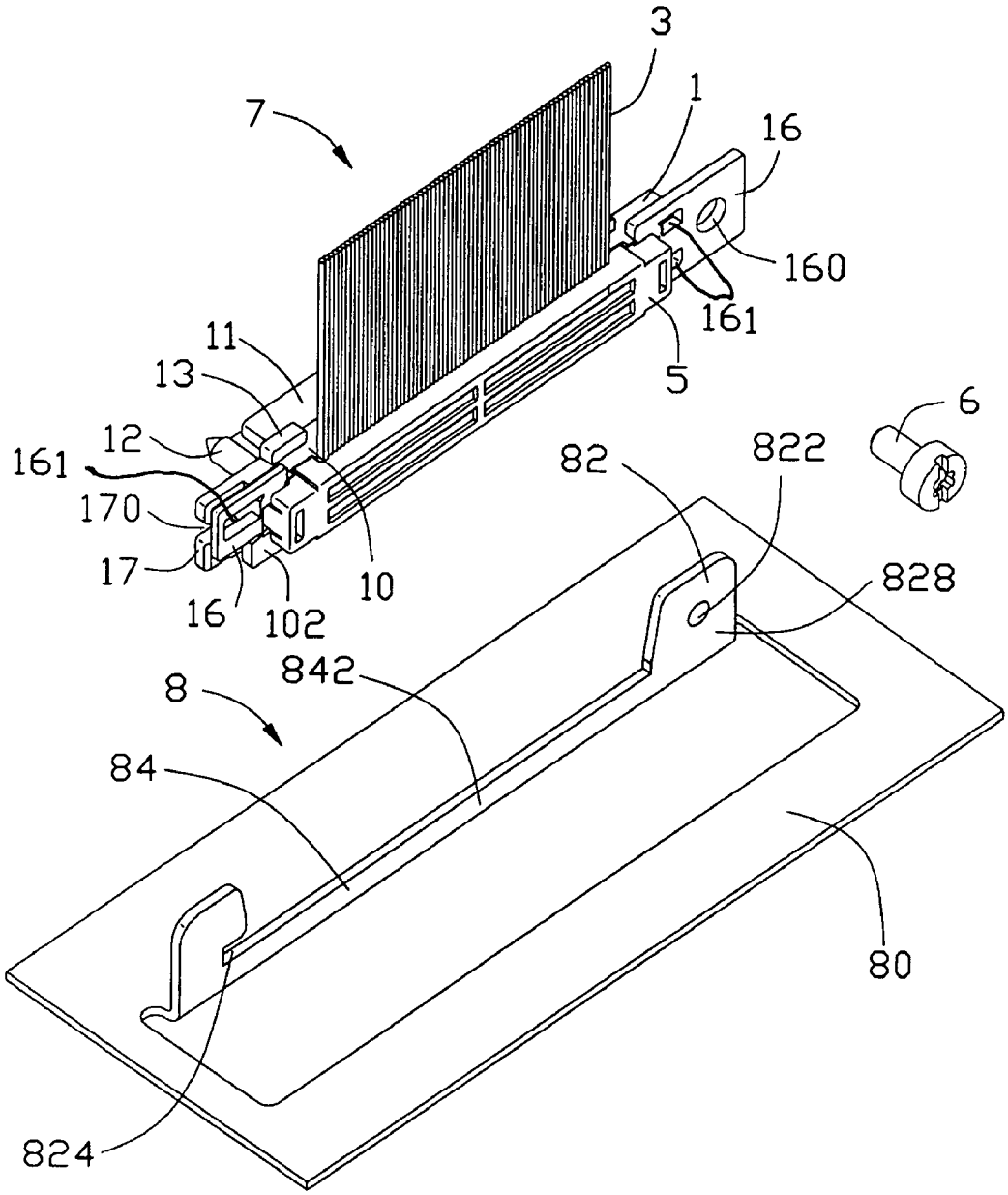
FIGS. 2 and 3 are views similar to FIG. 1, but taken from different aspects.
Figure 3:
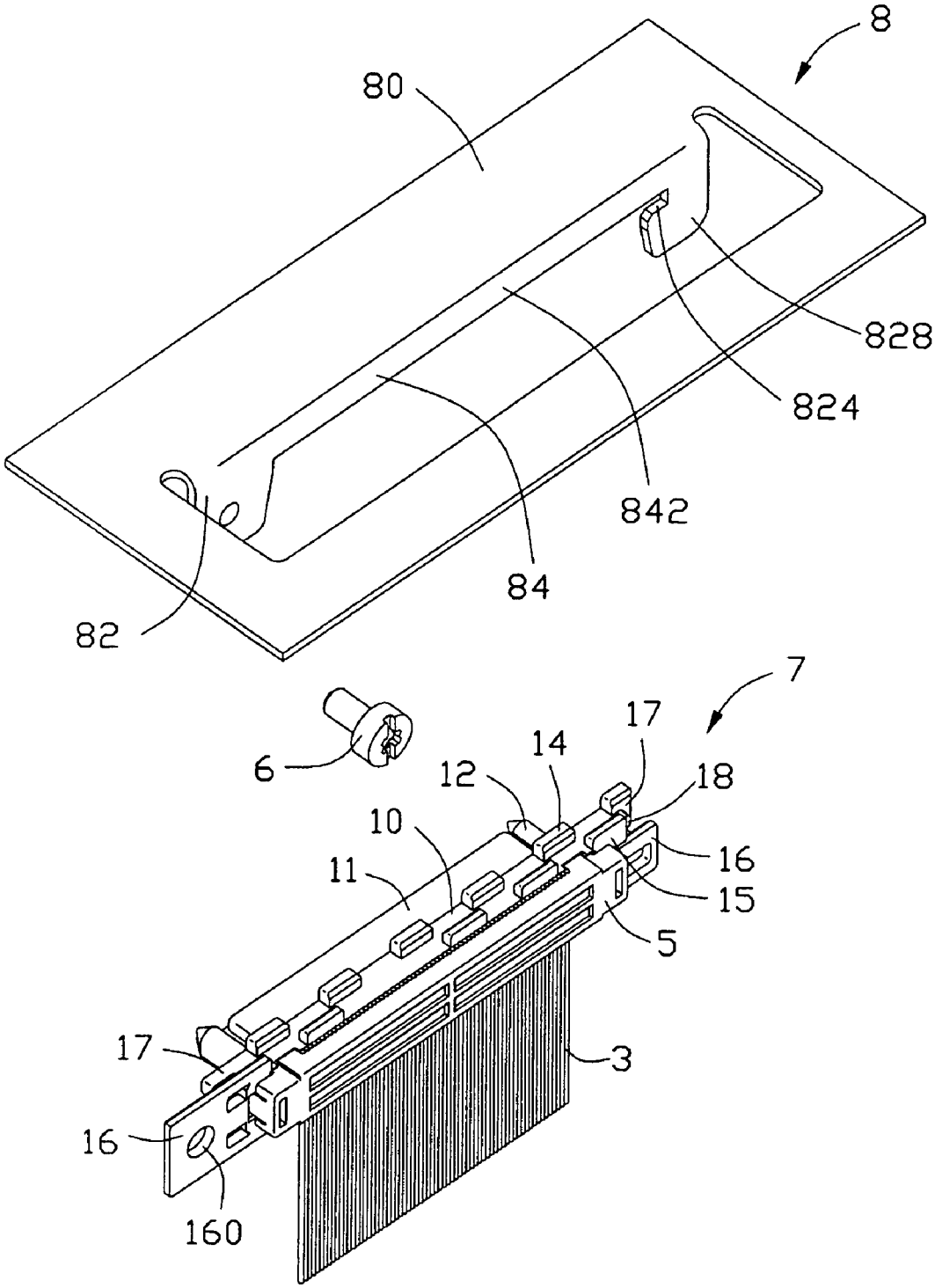
Figure 4:
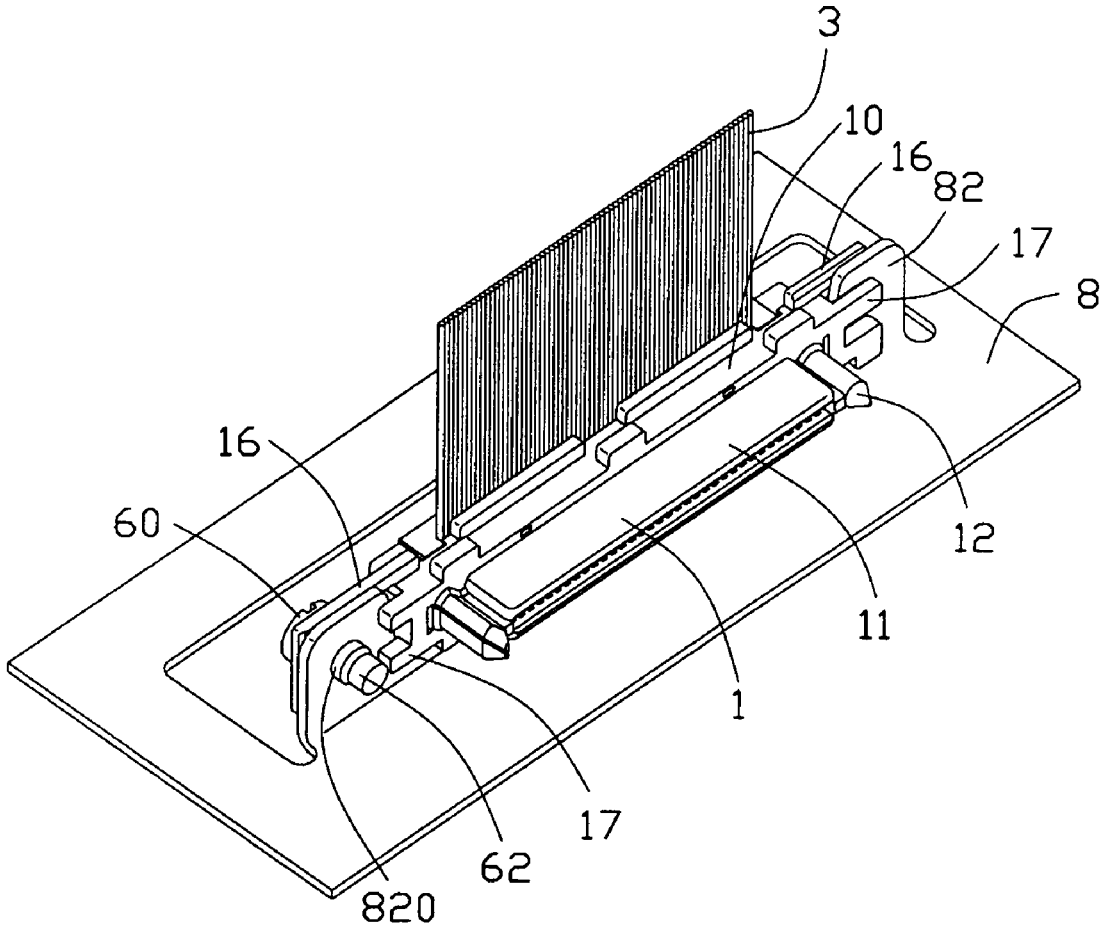
FIG. 4 is a perspective view showing the cable assembly mounted on the panel to form a system.
Figure 5:
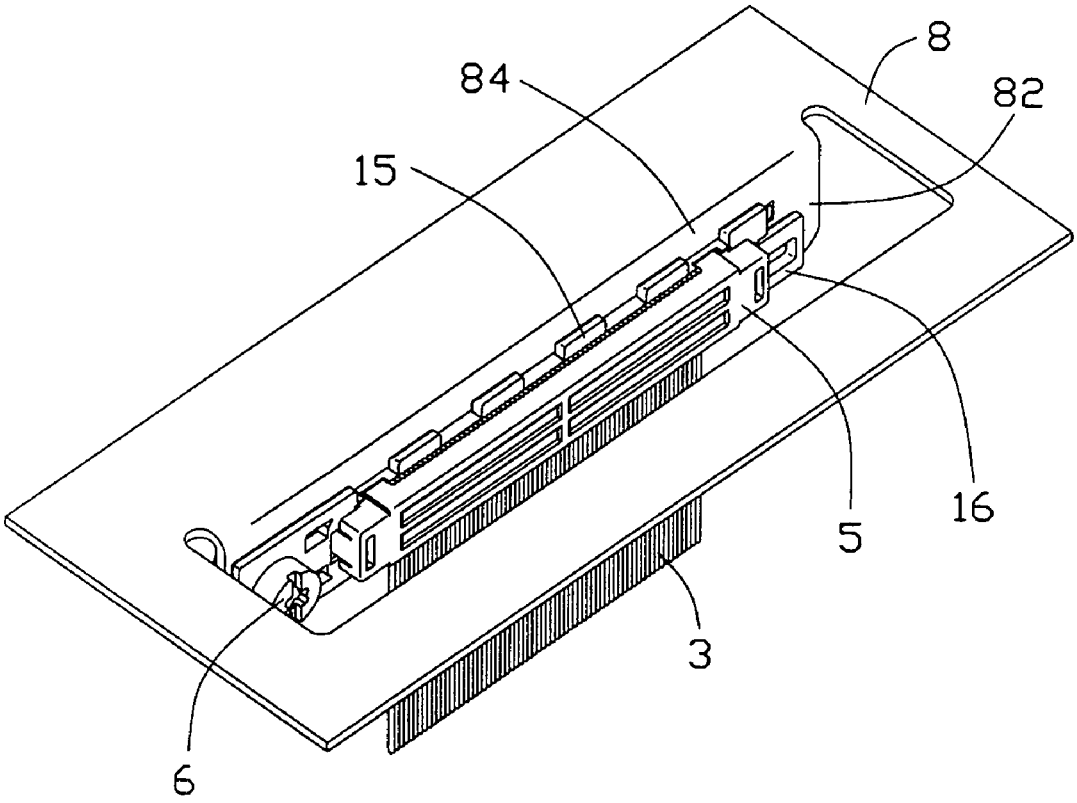
FIG. 5 is a view similar to FIG. 4 but taken from a different aspect.
Figure 6:
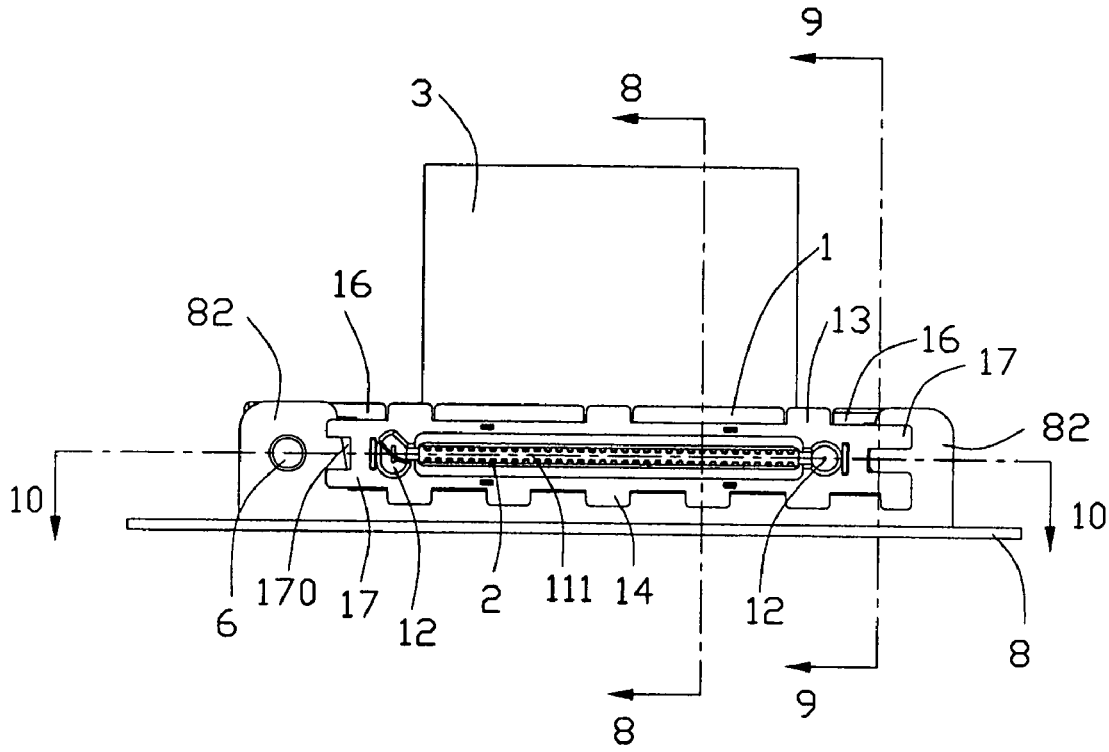
FIG. 6 is a front planar view of the system shown in FIG. 4.
Figure 7:
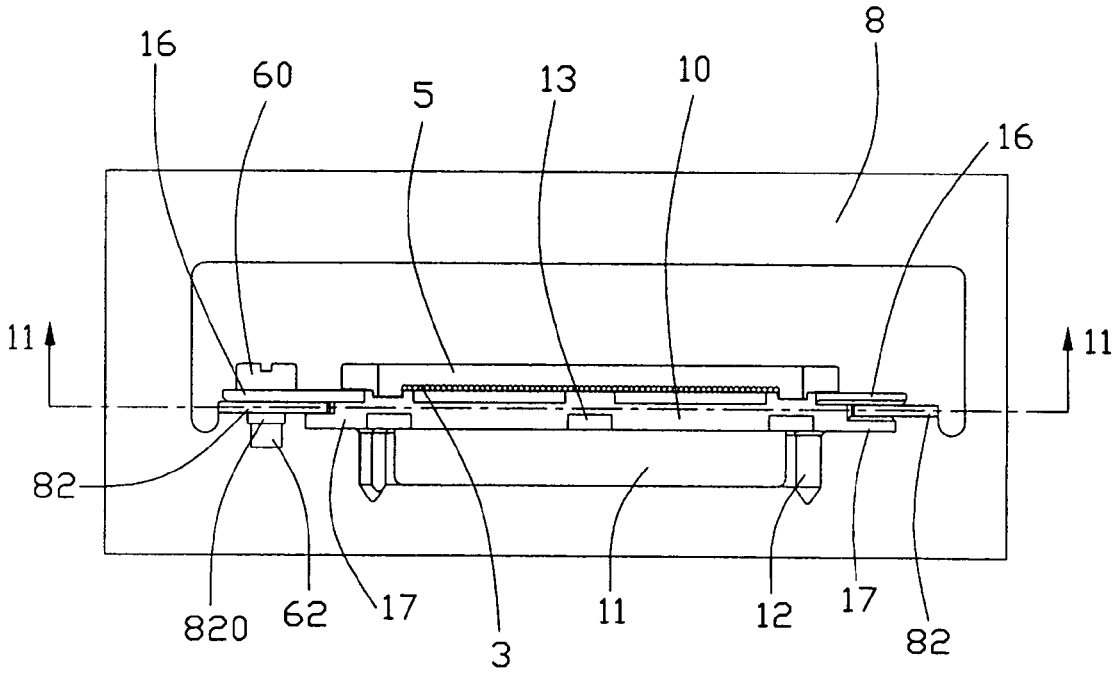
FIG. 7 is a top planar view of the system shown in FIG. 4.

Reference will now be made in detail to the preferred embodiment of the present invention.

Referring to FIGS. 1–3 and 8–11, a cable assembly 7 in accordance with the present invention, which is float-mounted on a panel 8 via a fastening member 6, comprises an insulative housing 1, a plurality of IDC (Insulation Displacement Contact) terminals 2 received in the insulative housing 1, a multi-conductor flat cable 3 electrically connecting with the terminals 2, a spacer 4 assembled to the insulative housing 1 for positioning insulation displacement sections of the terminals 2 and a termination cover 5 for being latchably mounted on the insulative housing 1. In a preferred embodiment, the cable assembly 7 is a SCA (Single Connector Attachment) cable assembly.

The insulative housing 1 is substantially elongated and comprises a base 10 and a mating portion 11 extending perpendicularly and forwardly from a front face 101 of the base 10. The insulative housing 1 has a front mating face 110 facing a complementary connector (not shown) and a terminating face 102 opposite to the mating face 110. The insulative housing 1 also defines a mating direction and a longitudinal direction perpendicular to the mating direction.

A pair of guiding members 12 protrude forwardly from the base 10 at opposite sides of the mating portion 11 and beyond the mating face 110 of the insulative housing 1 for guiding the cable assembly 7 to correctly mate with a complementary connector (not shown). The base 10 is formed with a plurality of bumps 13 on an upper face thereof. A row of protrusions 14 and a row of bulges 15 is formed on a lower face of the base 10. The distance between each protrusion 14 and each bulge 15 along the mating direction is substantially equal to a thickness of the panel 8. A pair of flanges 16 extends longitudinally from opposite ends of the base 10 and each is generally aligned with the bulges 15 along the longitudinal direction of the insulative housing 1. One of the flanges 16 defines a through hole 160 therethrough along the mating direction. A pair of ears 17 extends longitudinally from opposite ends of the base 10 and each is generally aligned with the protrusions 14 along the longitudinal direction of the insulative housing 1. Each ear 17 is parallel to the flange 16 and defines a cutout 170 at a free end thereof. The distance/space/slot S between each flange 16 and each ear 17 along the mating direction is substantially equal to the thickness of the panel 8. The base 10 is further formed with a key 18 at an end opposite to the flange 16 in which the through hole 160 is defined.

The insulative housing 1 defines a receiving space 111 in the mating face 110, a cavity 104 in the terminating face 102 and a plurality of passageways 112 in opposite longitudinal inner faces of the mating portion 11 and communicating with the cavity 104 and the receiving space 111. The base 10 defines a pair of channels 106 (FIG. 10) at opposite ends thereof. The base 10 is formed with a pair of mounting wedges 114 extending beyond the terminating face 102 and adjacent the channels 106.

Figure 8:
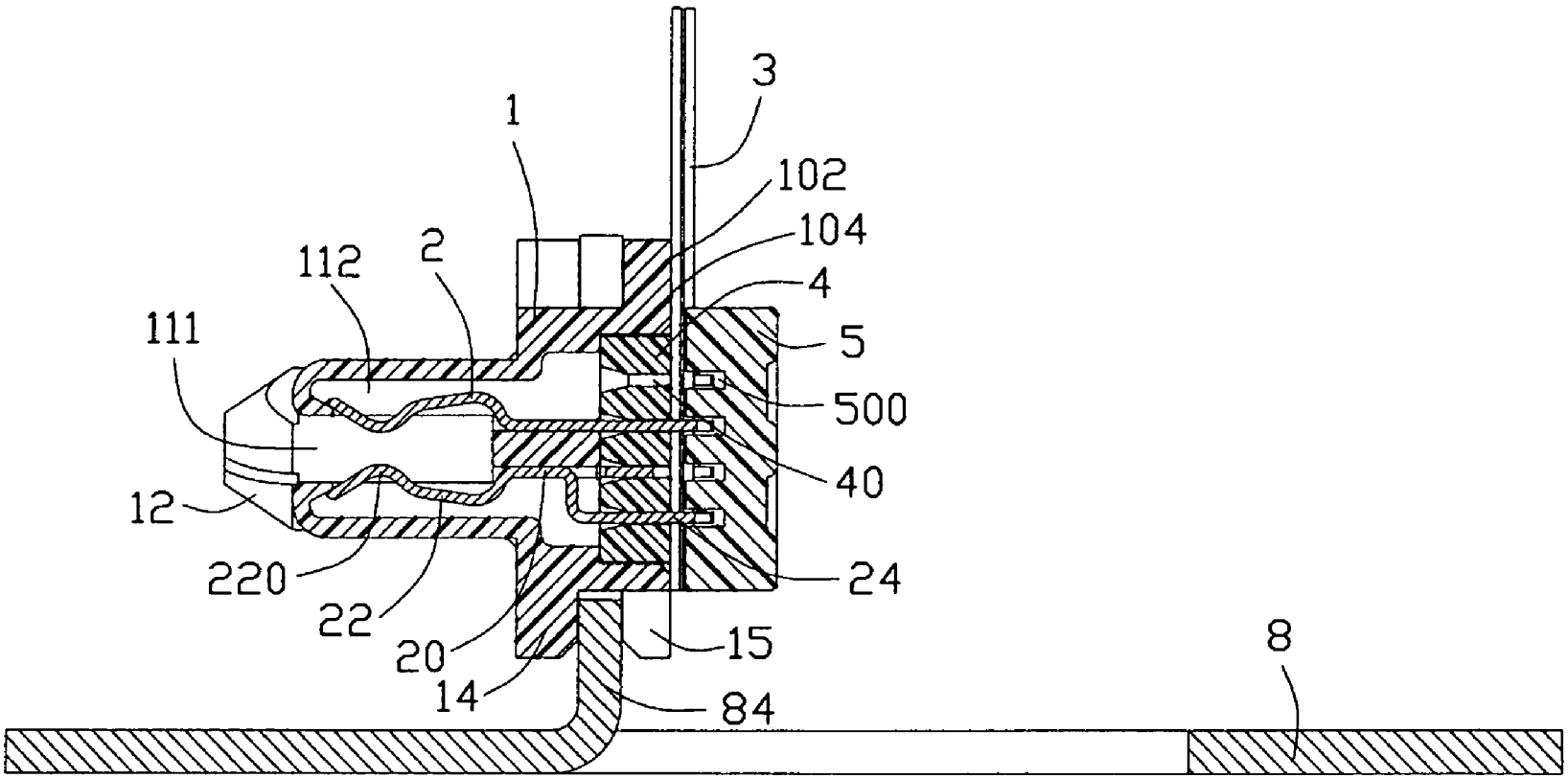
FIG. 8 is a cross-section view taken along line 8—8 of FIG. 6.
Figure 9:
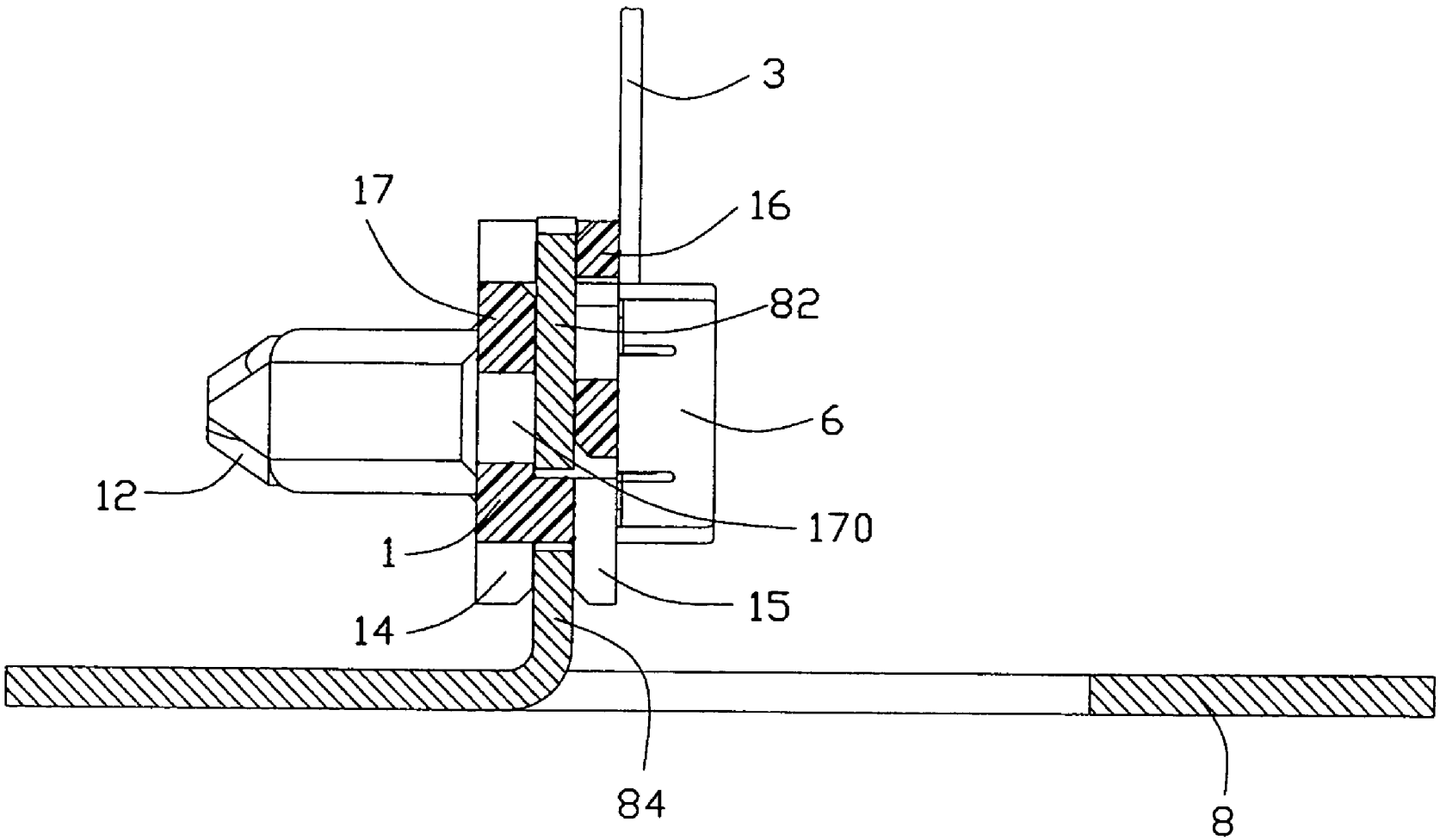
FIG. 9 is a cross-section view taken along line 9—9 of FIG. 6.
Figure 10:
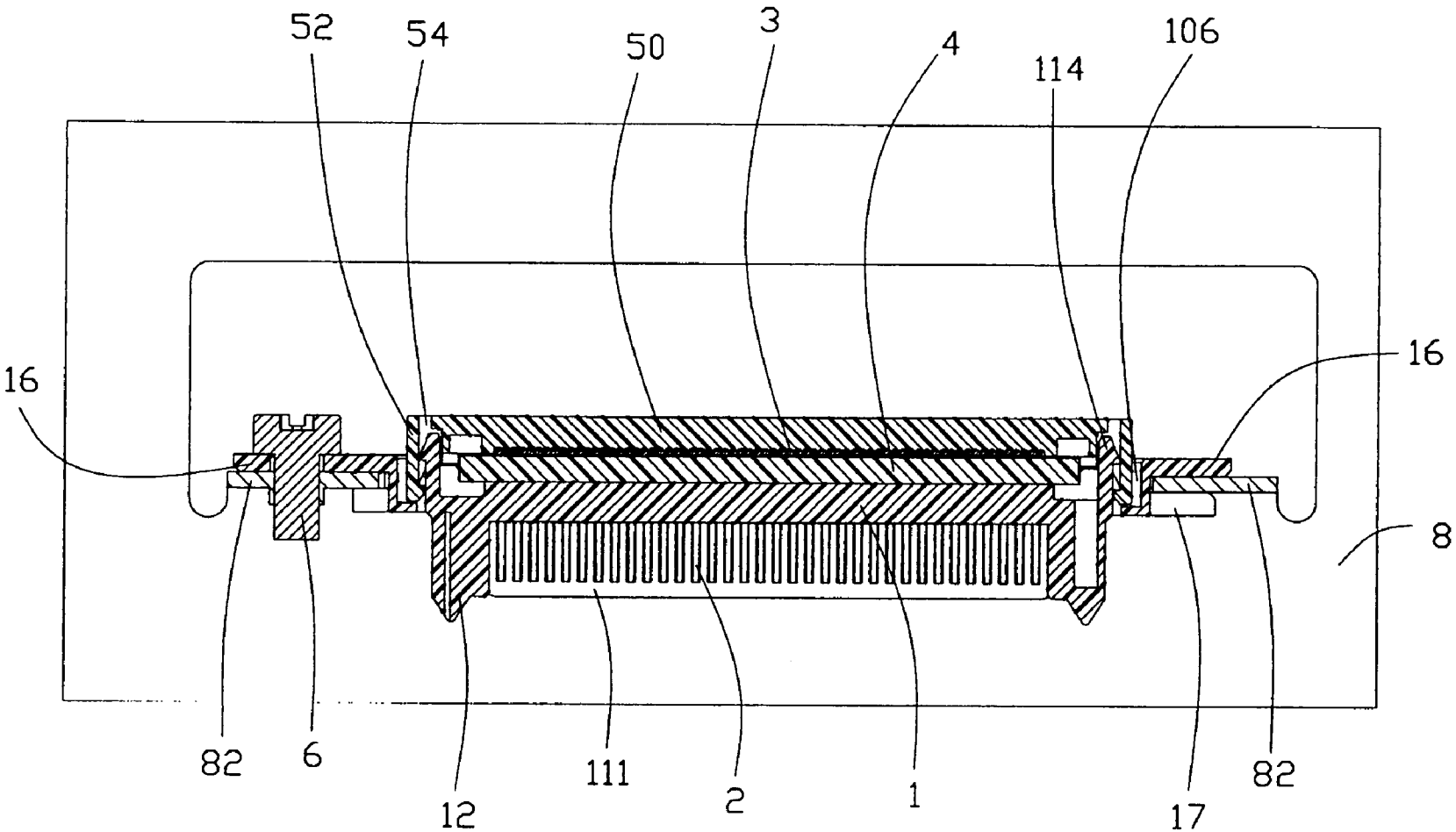
FIG. 10 is a cross-section view taken along line 10—10 of FIG. 6.
Figure 11:
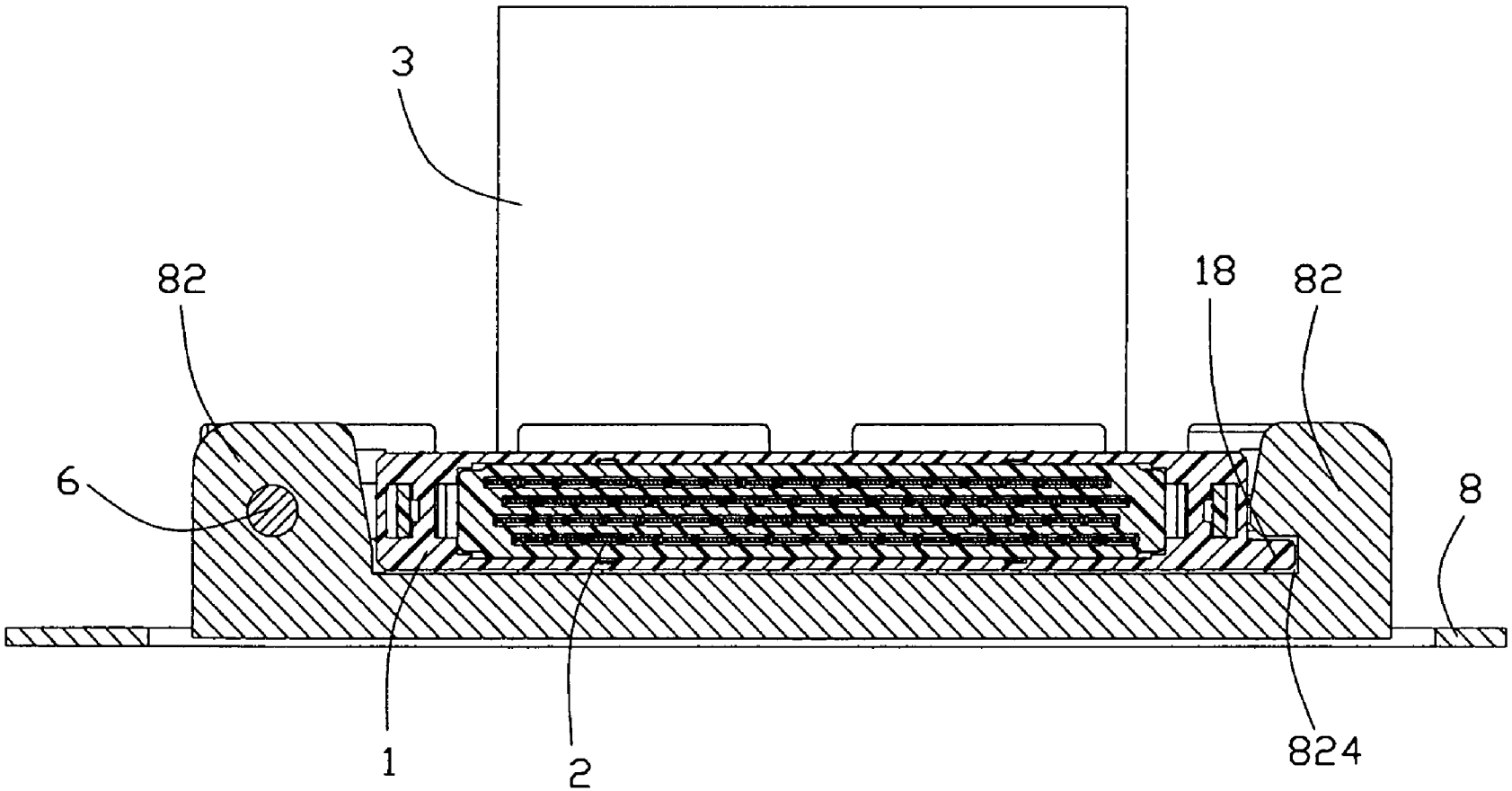
FIG. 11 is a cross-section view taken along line 11—11 of FIG. 7.

Referring to FIG. 8, the terminals 2 are received in the passageways 112 of the insulative housing 1. Each terminal 2 comprises a retention section 20 secured in a corresponding passageway 112, a mating section 22 extending from one end of the retention section 20 with a curved mating end 220 exposed into the receiving space 111, and an insulation displacement section 24 extending from the other end of the retention section 20.

The spacer 4 is elongated and is made of insulative material. The spacer 4 is received in the cavity 104 of the insulative housing 1 and defines a plurality of slots 40 with the insulation displacement sections 24 of the terminals 2 extending therethrough for positioning purpose.

The termination cover 5 is assembled to a rear of the insulative housing 1 to perform electrical connections between the cable 3 and the insulation displacement sections 24 of the terminals 2. The termination cover 5 includes a main body 50, a pair of forwardly extending mounting lugs 52 at opposite ends thereof, and a pair of through holes 54 adjacent the mounting lugs 52. The main body 50 defines a plurality of grooves 500 in a front face thereof for receiving the insulation displacement sections 24 of the terminals 2. The pair of mounting lugs 52 of the termination cover 5 and the pair of mounting wedges 114 of the insulative housing 1 are respectively received in the channels 106 of the insulative housing 1 and the through holes 54 of the cover 5 to thereby latch with each other. Thus, the cover 5 is securely assembled to the insulative housing 1.

Referring back to FIG. 1, the fastening member 6 includes an enlarged head 60 and a threaded portion 62 extending from the enlarged head 60.

The panel 8 is a rectangular board and includes a horizontal body 80, a pair of mounting wings 82 integrally extending from the horizontal body 80, and an elongated bridge 84 connected between the mounting wings 82 at a lower position thereof. The mounting wings 82 and the bridge 84 are bent from the horizontal body 80 to be substantially perpendicular to the horizontal body 80. The mounting wings 82 together define an opening 86 therebetween for accommodating the cable assembly 7. One of the mounting wings 82 is formed with a post 820 on a front side thereof and defines a mounting hole 822 corresponding to the through hole 160 of the insulative housing 1. The mounting hole 822 extends from a front face of the post 820 through a rear side of the corresponding mounting wing 82. The other mounting wing 82 defines a keyway 824 in an inner side thereof and adjacent to the bridge 84.

Referring to FIGS. 4–7 in conjunction with FIGS. 8–11, when the cable assembly 7 is assembled to the panel 8, the key 18 of the base 10 is received in the keyway 824 of the panel 8 for positioning the cable assembly 7 on the panel 8. The base 10 is received in the opening 86 of the panel 8 with the mounting wings 82 sandwiched between the flanges 16 and the ears 17 and with the bridge 84 sandwiched between the protrusions 14 and the bulges 15. The flange 16 abuts against a corresponding mounting wing 82 with the through hole 160 aligned with the mounting hole 822. The threaded portion 62 of the fastening member 6 engages with the through hole 160 of the flange 16 of the insulative housing 1 and extends into the mounting hole 822 of the panel 8.

When the complementary connector engages with or disengages from the cable assembly 7, the cable assembly 7 tends to rotate about the mounting wings 82. Since the protrusions 14 and the bulges 15 respectively abut against front and rear faces 840, 842 of the bridge 84 of the panel 8, the ears 17 and the flanges 16 respectively abut against front and rear faces 826, 828 of the mounting wings 82 of the panel 8, the cable assembly 7 is thus prevented from rotating when engaging with or disengaging from the complementary connector.

One feature of the invention is to form the slot S in the housing 1 to receive the wing without using a slide mold in the mold design. Understandably, traditionally because the passageway 112 extend in the front-to-back direction while the slot extends in a direction perpendicular to the front-to-back direction, during injection molding it is required to use the slide mold moving along the lateral direction other than the primary male/female molds moving along the front-to-back direction perpendicular to that lateral direction. Differently, in the instant invention to eliminate the slide mold for saving money, the housing 1 of the instant invention purposely has the corresponding portions by two sides of the slot S being (laterally) offset from each other for not overlapping with each other in the front-to-back direction while still keeping/forming the slot S therebetween structurally. Thus, referring to FIG. 1 in the flange 16 of the housing 1 a plurality of through openings 161 are formed in alignment with the corresponding ears 17 in the front-to-back direction. Based upon this specific housing structure design, during injection molding the corresponding projecting pins of the male/female molds are allowed to pass through the flange 16 by means of those through openings 161 for forming a forward side of the ear 17, thus eliminating the slide mold. In brief, via the offset flange 16 and ear 17, it is allowed to form the slot S between the flange 16 and the ear 17 without the slide mold during injection molding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly adapted for being mounted to a pair of mounting wings of a panel, comprising:

an insulative housing defining a mating direction and a longitudinal direction perpendicular to the mating direction, the insulative housing comprising a base, a mating portion extending forwardly from a front face of the base along the mating direction, a pair of flanges located at opposite ends of the base adapted for engaging with first faces of the mounting wings of the panel, and a pair of ears located at the opposite ends of the base and spaced from the flanges along the mating direction adapted for engaging with opposite second faces of the mounting wings of the panel, one of the flanges defining a through hole adapted for receiving a fastening member; and a plurality of terminals received in the insulative housing;

wherein the pair of flanges and the pair of ears all extend from the opposite ends of the base along the longitudinal direction;

wherein each ear defines a cutout at a free end thereof;

wherein the base includes a protrusion and a bulge on a bottom face thereof adapted for engaging with opposite first and second faces of a bridge connected between the mounting wings;

wherein the housing comprises a pair of guiding members forwardly extending from the base proximate to two sides of the mating portion, respectively;

wherein a cable electrically connecting with the terminals;

wherein a spacer defining a plurality of slots, and wherein the insulative housing has a mating face and a terminating face opposite to the mating face and defines a cavity extending from the terminating face toward the mating face to receive the spacer, the terminals comprising insulation displacement sections respectively protruding through the slots of the spacer;

wherein a cover assembled to a rear of the insulative housing, the cover defining a plurality of grooves receiving the insulation displacement sections of the terminals.

2. An electrical system comprising:

a panel including a body and a pair of spaced mounting wings integrally extending from the body, one of the mounting wings defining a mounting hole therethrough; and a cable assembly comprising:

an insulative housing comprising a base extending along a longitudinal direction, a mating portion extending forwardly from the base along a mating direction perpendicular to the longitudinal direction, and a pair of flanges and a pair of ears respectively engaging with opposite first and second faces of the mounting wings to counterbalance external force exerted on the cable assembly in the mating direction, one of the flanges defining a through hole in alignment with the mounting hole of the panel;

a plurality of terminals received in the insulative housing; and a fastening member extending through the through hole of the flange and the mounting hole of the mounting wing to mount the cable assembly on the panel;

wherein the mounting wing in which the mounting hole is defined is formed with a post on a front side thereof, the mounting hole extending from a front face of the post through a rear side of the mounting wing;

wherein the panel includes a bridge connecting the spaced mounting wings adjacent a lower position thereof;

wherein the base includes a protrusion and a bulge on a bottom face thereof respectively engaging with opposite first and second faces of the bridge;

wherein the other mounting wing defines a keyway in an inner side adjacent the bridge, and the base is formed with a key received in the keyway;

wherein the mounting wings and the bridge are bent upwardly from the body of the panel to be perpendicular to the body;

wherein the housing comprises a pair of guiding members forwardly extending from the base proximate to two sides of the mating portion, respectively.

3. An electrical system comprising:

a panel including a main body with spaced first and second mounting wings;

a first retention piece defined in the first mounting wing;

a second retention piece defined in the second mounting wing; and a cable connector assembly comprising:

a housing device enclosing a plurality of contacts in connection with a cable, and defining two opposite slots at two opposite ends to receive the corresponding wings, respectively, so as to restrict movement of the housing device relative to the panel in a direction perpendicular to said wings; wherein the first retention piece cooperates with a portion of the housing device to allow said housing device to be pivotal about said first retention piece until the an opposite portion of the housing device engages the second wing in said direction during assembling the housing device to the panel under a condition that the engagement between the first retention piece and said portion of the housing prevents the housing device from moving away from the first wing in other directions perpendicular to said direction, and the second retention piece cooperates with said opposite portion of the housing device to fasten the housing device to the second wing;

wherein said first and second wings are essentially perpendicular to the main body, and a mating direction of the housing device is parallel to said direction;

wherein said first and second wings are split from a central portion of the main body and thus leaving an opening therein;

wherein said first retention piece is a keyway and said portion of the housing device is a key.

* * * * *